US007982113B2

(12) United States Patent
Le et al.

(10) Patent No.: US 7,982,113 B2
(45) Date of Patent: Jul. 19, 2011

(54) METHOD FOR SYNCHRONIZING AT LEAST ONE MULTIMEDIA PERIPHERAL OF A PORTABLE COMMUNICATION DEVICE, AND CORRESPONDING PORTABLE COMMUNICATION DEVICE

(75) Inventors: Minh Le, Neuilly sur Seine (FR); Michael Guilbaud, Toulouse (FR); Muriel Gohn, Chatou (FR)

(73) Assignee: Imerj, Ltd., Grand Cayman (KY)

( * ) Notice: Subject to any disclaimer, the term of this patent is extended or adjusted under 35 U.S.C. 154(b) by 0 days.

(21) Appl. No.: 12/560,476

(22) Filed: Sep. 16, 2009

(65) Prior Publication Data

US 2010/0005951 A1 Jan. 14, 2010

Related U.S. Application Data

(63) Continuation of application No. 11/429,406, filed on May 5, 2006, now Pat. No. 7,605,320.

(30) Foreign Application Priority Data

May 12, 2005 (EP) ..... 05300371

(51) Int. Cl.
*G10H 7/00* (2006.01)

(52) U.S. Cl. ..... 84/464 R; 84/645; 84/477 R

(58) Field of Classification Search ..... 84/615, 84/618, 645, 464 R, 464 A, 477 R
See application file for complete search history.

(56) References Cited

U.S. PATENT DOCUMENTS

| | | | | |
|---|---|---|---|---|
| 6,567,068 | B2 | 5/2003 | Rekimoto | |
| 2002/0061772 | A1 | 5/2002 | Hayashi | |
| 2004/0139842 | A1 | 7/2004 | Brenner et al. | |
| 2005/0070241 | A1 * | 3/2005 | Northcutt et al. | 455/265 |

FOREIGN PATENT DOCUMENTS

| | | | |
|---|---|---|---|
| EP | 1 255 418 | | 6/2002 |
| WO | W02005043332 | A2 | 5/2005 |
| WO | W02005103863 | A2 | 11/2005 |

* cited by examiner

*Primary Examiner* — Jeffrey Donels
*Assistant Examiner* — Andrew R Millikin
(74) *Attorney, Agent, or Firm* — Robert G. Crouch; Marsh Fischmann & Breyfogle LLP

(57) ABSTRACT

A method and device of synchronizing at least one multimedia peripheral of a portable communication device with a synthetic audio file include storing parameters in the portable communication device. The parameters include a list of preferred instruments. Information is read from the synthetic audio file. The information relates to an instrument corresponding to each track available in the synthetic audio file. A track is selected from among the tracks available in the synthetic audio file based on the list of preferred instruments. At least one synchronization signal is generated from the synthetic audio file using the selected track.

20 Claims, 3 Drawing Sheets

METHOD FOR SYNCHRONIZING AT LEAST ONE MULTIMEDIA PERIPHERAL OF A PORTABLE COMMUNICATION DEVICE, AND CORRESPONDING PORTABLE COMMUNICATION DEVICE

CROSS-REFERENCE TO RELATED APPLICATIONS

This application is a continuation of U.S. patent application Ser. No. 11/429,406, filed May 5, 2006, which claims priority from European Patent Application No. 05 300 371.1, filed May 12, 2005, which are incorporated by reference as if fully set forth.

FIELD OF INVENTION

The present invention relates to a method for synchronizing at least one multimedia peripheral of a portable communication device, such as a mobile phone, with a synthetic audio file.

BACKGROUND

The wording "multimedia peripherals" relates here to the different parts of the portable communication which can be activated in synchronization with music, for instance, in case of a mobile phone:

- the ringer for alerting a user in case of reception of an incoming call or a message;
- vibrator means which might be used either instead of or combined with the ringing;
- the backlighting which is used for illuminating the display;
- the backlighting used for illuminating one or several keys on the keypad; and/or
- any dedicated illuminating devices such as leds which could be provided on the mobile phone.

Synthetic audio files relate to all kinds of files which contain numeric data enabling a synthesizer to generate a music or melody, such as the standardized files known as MIDI (Acronym for Musical Instrument Digital Interface), or SP-MIDI, or SMAF (Acronym for Synthetic music Mobile Application Format). More precisely, MIDI files do not contain any sound. They are in fact text files, containing encoded commands which enable a synthesizer to play notes. Numbers specify each note's position relative to the start of the music and its time-value, and its volume, including crescendos and diminuendos. Other commands set the instrument (e.g. 1=Grand Piano, 74=Flute) for each track/channel, the tempo changes and the overall volume and stereo balance per track.

Providing a portable communication device, such as a mobile phone, with means to synchronize one peripheral multimedia, as defined hereinabove by way of non-limitative examples, with a synthetic audio file is already known.

Generally, the synthetic files used for this particular application are specific as they contain a particular instrument which is to be used for synchronizing one peripheral multimedia, for instance instrument 125 in case of the ringing tone or instrument 12 in case of the vibrator the ringer of the mobile phone. These specific synthetic files can be loaded in the memory of the mobile phone at the time of manufacturing. Alternatively, the user can download new synthetic files, via the cellular network to which the mobile phone is affiliated, via any type of networks including Internet, or from a PC. Once these files have been downloaded and stored in the memory of the mobile phone, the user has generally the possibility, via a specific menu, to choose the file which can be used for synchronizing each multimedia peripheral provided in its mobile phone.

The possibility for a user to give a personal touch to his or her portable communication device is consequently limited to what manufacturers or networks operators or services providers propose. However, the synthetic audio files which are proposed do not always correspond to the user's preferences.

A larger choice could be given to the user if he could use any type of synthetic audio files, even those which have not been created for the purpose of synchronizing a multimedia peripheral of a portable communication device. However in this case, if the file does not contain any information for the synchronization (for instance no track relating to either instrument 125 or to instrument 12), the user will not be able to use this file for synchronization purpose.

SUMMARY

The aim of the invention is to remedy the above drawback by proposing a solution enabling to systematically synchronize a multimedia peripheral with information coming from any type of synthetic audio file, whatever the content of this audio file, and especially even if no synchronization information is contained in this audio file.

To this aim, an embodiment of the present invention is to provide a method for synchronizing at least one multimedia peripheral of a portable communication device with a synthetic audio file, which method comprises a step of generating at least one synchronization signal from said synthetic audio file, further comprising the following steps:

- storing in the portable communication device a plurality of parameters including a list of preferred instruments;
- reading information from the synthetic audio file relating to an instrument corresponding to each track available in the synthetic audio file;
- selecting a track from among the tracks available in the synthetic audio file based on the list of preferred instruments; and
- generating at least one synchronization signal from the synthetic audio file using the selected track.

The parameters also include a predetermined frequency threshold. The step of reading further includes determining the frequency apparition of notes in said synthetic audio file for each extracted track. The selecting step includes choosing an extracted track corresponding to an instrument which belongs to said list of preferred instruments according to a comparison between the frequency apparition of notes and said predetermined frequency threshold.

For instance, an extracted track can be chosen if it corresponds to an instrument which belongs to said list of preferred instruments and if the frequency apparition of notes for this track is greater or equal to said predetermined frequency threshold.

According to one possible embodiment of the invention, the method may further comprise a step for determining if a synchronization track is present in said synthetic audio file.

In case a synchronization track is determined, said synchronization track may be automatically chosen for generating said synchronization signal. Alternatively, it can be decided to choose another track as a function of said parameters, even in case a synchronization track has been found. Alternatively, it can also be decided to elect the best track between either a synchronization track or another extracted track chosen as a function of said parameters.

In any case, the method according to the invention enables a user to use any kind of synthetic audio file, regardless of whether a synchronization track is included in the file.

The selecting step preferably includes choosing an extracted track corresponding to an instrument which belongs to said list of preferred instruments.

The parameters may also include priority information for each preferred instrument. In this case, the extracted track will be preferably chosen according to said priority information.

A second embodiment of the present invention is a portable communication device comprising at least one multimedia peripheral which can be activated with synchronism with at least one synchronization signal generated from a synthetic audio file, comprising:

- at least one multimedia peripheral that can be activated in synchronization with at least one synchronization signal generated using a selected track that is selected from a plurality tracks available in a synthetic audio file;
- a memory configured to store at least one parameter including a list of preferred instruments;
- a reading unit configured to read information from the synthetic audio file relating to an instrument corresponding to each track available in the synthetic audio file;
- a selecting unit configured to select a track from among the tracks available in the synthetic audio file based on the list of preferred instruments; and
- a generating unit configured to generate the at least one synchronization signal from the synthetic audio file using the selected track.

BRIEF DESCRIPTION OF THE DRAWING(S)

Other features and advantages of the invention will become apparent from the following description of embodiments of the invention given by way of non-limiting examples only and with reference to the accompanying drawings, in which.

DETAILED DESCRIPTION OF THE PREFERRED EMBODIMENT(S)

Figure 1:
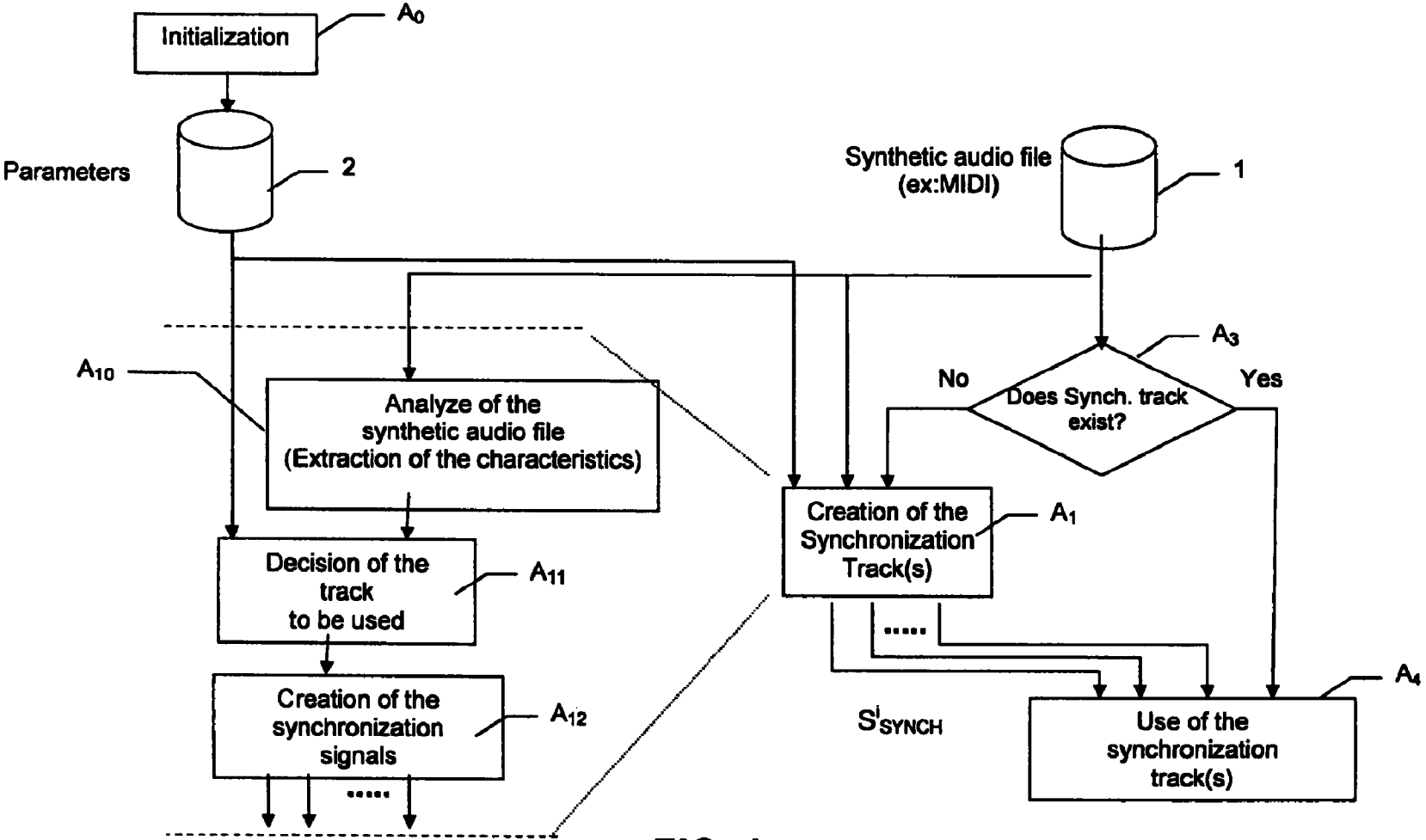
FIG. 1 shows schematically the different steps involved in the method according to a first possible embodiment of the present invention.
Figure 2:
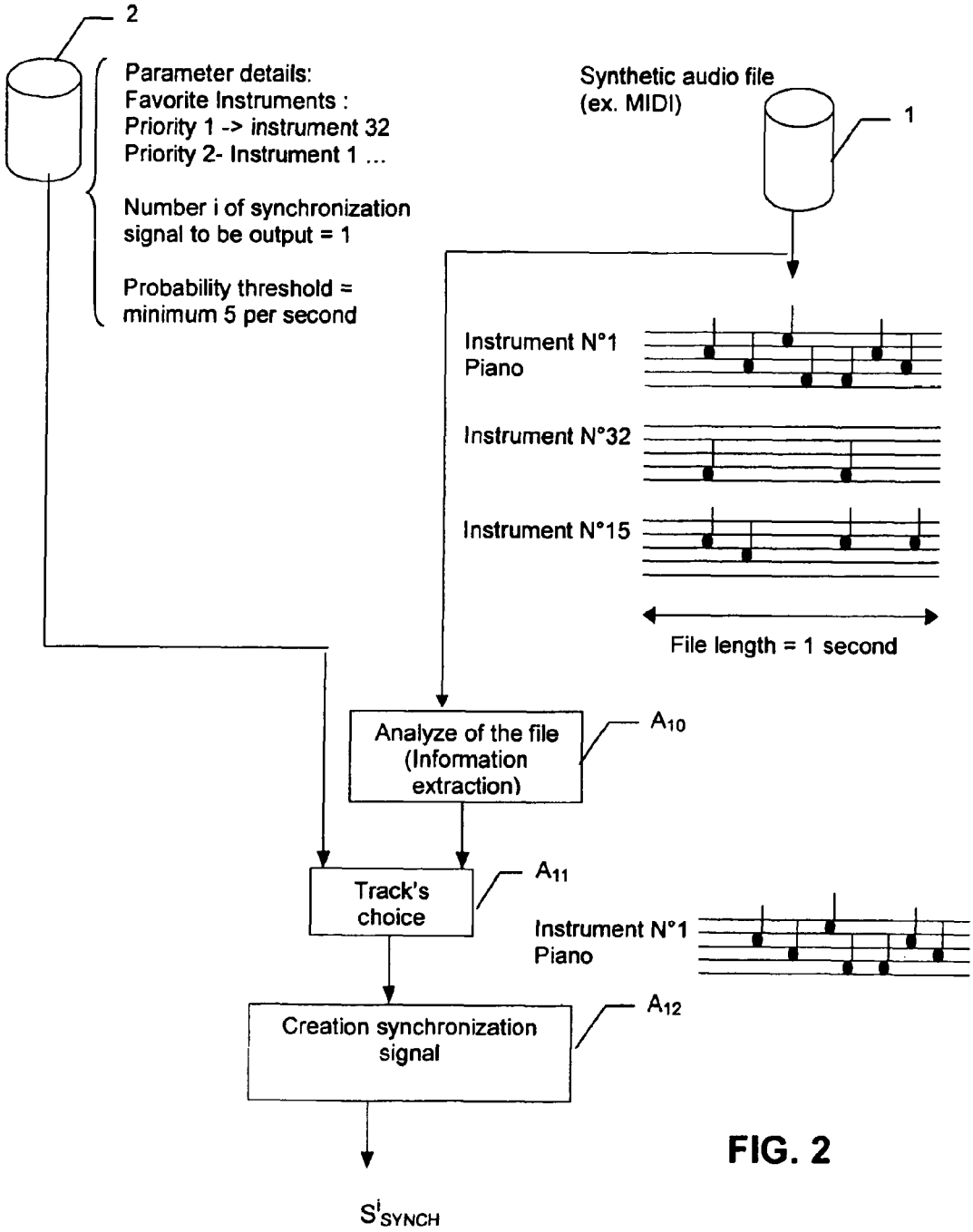
FIG. 2 shows an example of synchronization extraction according to the present invention, for a particular example of MIDI file.

In relation to FIGS. 1 and 2, the method for synchronizing at least one multimedia peripheral of a portable communication device includes generating at least one synchronization signal $S^i_{SYNCH}$ from a given synthetic audio file 1.

According to a first aspect of the invention, the method comprises an initialization step $A_0$ during which some parameters 2, including at least a list of preferred instruments, are stored in said portable communication device.

The initialization step $A_0$ may be performed at the manufacturing of the portable communication device. Alternatively or in combination, a suitable menu can be configured by the user himself.

In the example shown on FIG. 2, the list of preferred instruments comprises two favorite instruments, namely instrument No 32 (corresponding to Guitar harmonic for the MIDI standard) and instrument No 1 (corresponding to Grand Piano for the MIDI standard).

According to a second aspect of the invention, a generating step $A_1$ is performed, comprising a step $A_{10}$ of analyzing information read from synthetic audio file 1 and relating to each instrument for which a track can be extracted in the synthetic audio file. The method may also include step $A_{11}$ of deciding which extracted track is to be used for generating said synchronization signal as a function of the parameters.

For illustrative purposes, assume that synthetic audio file 1 contains several tracks corresponding to several instruments, among which may include as illustrated on FIG. 2, at least the following tracks:

- a track relating to Instrument No 1 (Piano) with the corresponding notes to be played for this instrument;
- a track relating to Instrument No 32 (Guitar harmonic) with the corresponding notes to be played for this instrument;
- a track relating to Instrument No 15 (tubular bells) with the corresponding notes to be played for this instrument.

In the example of FIG. 2, the score corresponding to each of the instruments has been given for duration of one second. Of course, longer durations are possible.

During generating step $A_1$, and more precisely during step $A_{10}$, at least those three tracks will be extracted.

Deciding step $A_{11}$ includes choosing an extracted track corresponding to an instrument which belongs to the list of preferred instruments. Extracted tracks corresponding to instrument No 15 will not be considered furthermore since they do not belong to the list of preferred instruments.

In this preferred embodiment, parameters 2 also include priority information for each preferred instrument. In this case, the extracted track will be preferably chosen according to said priority information. For the given example, priority information has been set to priority 1 for instrument No 32 and to priority 2 for instrument No 1, which means that as both tracks corresponding to both instruments can be found in synthetic audio file 1, preference will be given to instrument No 32.

Other parameters can be added: in the preferred embodiment, parameters 2 also include a predetermined probability or frequency threshold. In this specific case, step $A_{10}$ of analyzing information further comprises determining the frequency apparition of notes (i.e., the number of notes per unit of time) in synthetic audio file 1 for each extracted track. Deciding step $A_{11}$ includes choosing an extracted track not only corresponding to an instrument which belongs to said list of preferred instruments, but also according to a comparison between the frequency apparition of notes and the predetermined frequency threshold. The comparison may include selecting a track only among the extracted tracks for which the frequency apparition of notes is greater or equal to the predetermined frequency threshold.

In the example of FIG. 2, the frequency threshold is set to a minimum of 5 notes per second. Analysis of file 1 performed at step $A_{10}$ shows that seven notes exist for instrument No 1, while only two notes exist for instrument No 32. In this case, decision on the track performed at step $A_{11}$ may include choosing track No 1, despite the fact that priority 1 was set for instrument No 32, because the frequency apparition of notes for instrument No 32 is below the frequency threshold.

Parameters 2 may also include the number I of synchronization signals which must be output. In the example of FIG. 1, this number has been set to 1. Parameters 2 could also comprise criteria relating to duration of notes, like a duration threshold. In this case, analysis of the duration of notes is performed for each instrument of the audio file, and only instruments for which the greater number of notes having a duration superior to the duration threshold is selected.

Another parameter could be a transition threshold between two successive notes for the same track, etc.

At last, synchronization signal $S^1_{SYNCH}$ created at step $A_{12}$ from the selected track. This signal can correspond to a succession of pulses corresponding to each note of the selected track or may be adapted according to the type of peripheral which must be activated.

According to one possible embodiment of the invention, said method may further comprise a step $A_3$ for determining if a synchronization track is present in the synthetic audio file.

In case a synchronization track is determined to be present in the synthetic audio file, the synchronization track may be automatically chosen for generating the synchronization signal. Alternatively, it can be decided to choose another track as a function of parameters 2, even when a synchronization track has been found. Alternatively, it can also be decided to elect the best track between either a synchronization track or another extracted track chosen as a function of parameters 2. This last case corresponds to what is shown on FIG. 1, wherein step $A_4$ enables selecting the best track.

Figure 3:
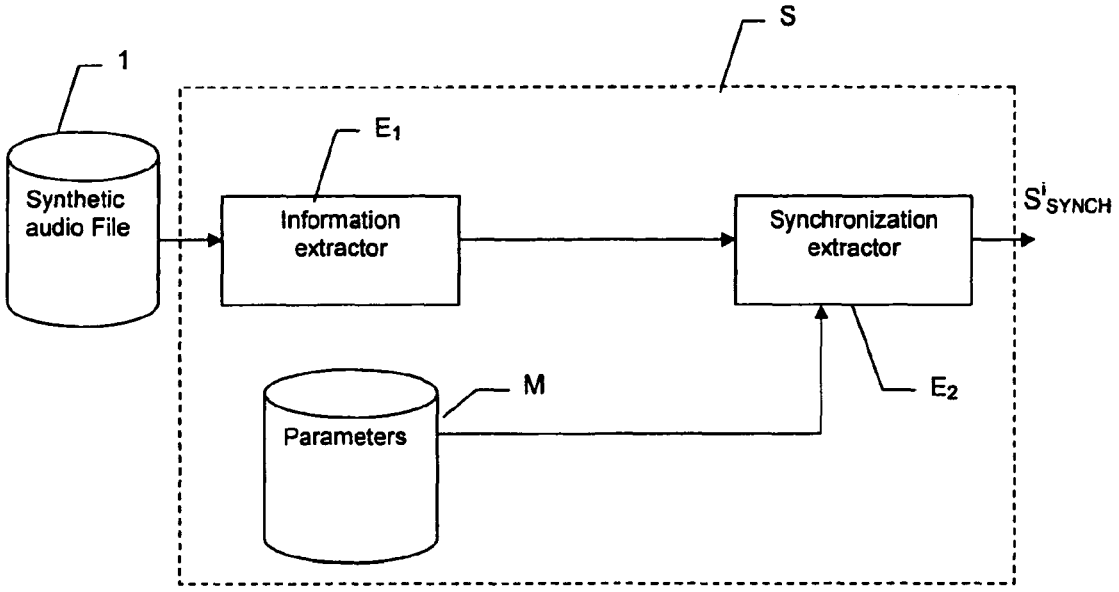
FIG. 3 illustrates schematically possible means to implement the method according to the present invention.

FIG. 3 shows schematically part of a portable communication device that implements the method described above. The illustrated portable communication device comprises at least one multimedia peripheral (not shown) which can be activated with synchronism with at least one synchronization signal $S^i_{SYNCH}$ generated from a synthetic audio file 1 stored in a memory of the device. The portable communication device comprises synchronization generation means S including:

means M for storing in the portable communication device parameters 2 including at least a list of preferred instruments and eventually other parameters (such as priority information, frequency threshold, and/or number of signals to be generated);

first extractor means $E_2$ for reading and analyzing information read from synthetic audio files relating to each instrument for which a track can be extracted in the synthetic audio file 1; and second extractor means $E_2$ for first selecting which extracted track is to be used for generating the synchronization signal $S^i_{SYNCH}$ as a function of the parameters and creating the synchronization signal $S^i_{SYNCH}$.

The above synchronization generation means are controlled by the portable device's software.

Peripherals which can be activated in synchronism with synchronization signal $S^i_{SYNCH}$ can be a ringer, vibrator, display backlight, key backlight, and/or any dedicated light emitting diode (LED) on the portable communication device.

What is claimed is:

1. A portable communication device comprising:

at least one multimedia peripheral to be activated in synchronization with at least one synchronization signal generated using a selected track that is selected from a plurality tracks available in a synthetic audio file;

a memory to store at least one parameter including a desired number of notes per unit length of time;

a reading unit to read information from the synthetic audio file relating to an actual number of notes per unit length of time of each track available in the synthetic audio file;

a selecting unit to select a track from among the tracks available in the synthetic audio file based on a comparison of the desired number of notes per unit length of time and the actual number of notes per unit length of time of each track; and a generating unit to generate the at least one synchronization signal from the synthetic audio file using the selected track.

2. The device of claim 1, wherein the reading unit is further to determine if a synchronization track is present in the audio file.

3. The device of claim 2, wherein, responsive to the reading unit determining that the synchronization track is present in the synthetic audio file, the selecting unit is to select the synchronization track for use in generating the at least one synchronization signal.

4. The device of claim 1, wherein the multimedia peripheral is at least one of a ringer, a vibrator, a display backlight, a key backlight and a dedicated light emitting diode (LED).

5. The portable communication device of claim 1, wherein the selecting unit is further to select the track from among the tracks available in the synthetic audio file for which the actual number of notes per unit length of time is greater than or equal to the desired number of notes per unit length of time.

6. The portable communication device of claim 1, wherein the at least one parameter further includes a list of preferred instruments.

7. The portable communication device of claim 6, wherein the selecting unit is further to select the track from among the tracks based on both the comparison of the desired number of notes per unit length of time and the actual number of notes per unit length of time of each track and on whether the track corresponds to an instrument included in the list of preferred instruments.

8. The portable communication device of claim 1, wherein the at least one parameter further includes a number of synchronization signals to be output.

9. The portable communication device of claim 1, wherein the at least one parameter further includes a desired duration of notes.

10. The portable communication device of claim 1, wherein the at least one parameter further includes a transition threshold between successive notes for the same track.

11. A method of synchronizing at least one multimedia peripheral of a portable communication device with a synthetic audio file, the method comprising:

receiving in the portable communication device at least one parameter including a desired number of notes per unit length of time;

reading information from the synthetic audio file relating to an actual number of notes per unit length of time of each track available in the synthetic audio file;

selecting a track from among the tracks available in the synthetic audio file based on a comparison of the desired number of notes per unit length of time and the actual number of notes per unit length of time of each track; and generating at least one synchronization signal from the synthetic audio file using the selected track.

12. The method of claim 11, further comprising determining if a synchronization track is present in the audio file.

13. The method of claim 11, further comprising selecting the synchronization track for use in generating the at least one synchronization signal responsive to determining that the synchronization track is present in the synthetic audio file.

14. The method of claim 11, wherein selecting the track from among the tracks available in the synthetic audio file further comprises selecting the track for which the actual number of notes per unit length of time is greater than or equal to the desired number of notes per unit length of time.

15. The method of claim 11, wherein the at least one parameter further includes a list of preferred instruments.

16. The method of claim 15, wherein selecting the track from among the tracks available in the synthetic audio file further comprises selecting the track based on both the comparison of the desired number of notes per unit length of time and the actual number of notes per unit length of time of each track and on whether the track corresponds to an instrument included in the list of preferred instruments.

17. The method of claim 11, wherein the at least one parameter further includes a number of synchronization signals to be output.

18. The method of claim 11, wherein the at least one parameter further includes a desired duration of notes.

19. The method of claim 11, wherein the at least one parameter further includes a transition threshold between successive notes for the same track.

20. A portable communication device comprising:

means for receiving in the portable communication device a desired number of notes per unit length of time;

means for reading information from a synthetic audio file relating to an actual number of notes per unit length of time of each track available in the synthetic audio file;

means for selecting a track from among the tracks available in the synthetic audio file based on a comparison of the desired number of notes per unit length of time and the actual number of notes per unit length of time of each track; and means for generating a least one synchronization signal from the synthetic audio file using the selected track.

* * * * *